US006504136B2

(12) United States Patent
Snowball

(10) Patent No.: US 6,504,136 B2
(45) Date of Patent: Jan. 7, 2003

(54) LIQUID HEATING APPARATUS WITH AN INDUCTIVELY HEATED IMPELLER

(76) Inventor: Malcolm Robert Snowball, "Woodside", 4 The Gables, The Plain, Epping, Essex, CM16 6TW (GB)

( * ) Notice: Subject to any disclaimer, the term of this patent is extended or adjusted under 35 U.S.C. 154(b) by 0 days.

(21) Appl. No.: 10/013,415

(22) Filed: Dec. 10, 2001

(65) Prior Publication Data

US 2002/0047008 A1 Apr. 25, 2002

Related U.S. Application Data

(63) Continuation-in-part of application No. 09/784,513, filed on Feb. 15, 2001, now abandoned.

(30) Foreign Application Priority Data

Feb. 19, 2000 (GB) ..... 0003802

(51) Int. Cl.[7] ..... H05B 6/10

(52) U.S. Cl. ..... 219/631; 219/630; 219/62 B; 219/672; 219/677; 219/632

(58) Field of Search ..... 219/631, 630, 219/628, 629, 670, 672, 632, 674, 675, 676, 677

(56) References Cited

U.S. PATENT DOCUMENTS 4,238,337 A * 12/1980 Peters et al. ..... 219/629
4,421,967 A * 12/1983 Birgel et al. ..... 219/631
4,511,777 A * 4/1985 Gerard ..... 219/631
4,678,881 A * 7/1987 Griffith ..... 219/631
5,237,144 A * 8/1993 Iguchi ..... 219/628
5,407,331 A * 4/1995 Atsumi ..... 417/420
6,144,020 A * 11/2000 Usui et al. ..... 219/631
6,147,336 A * 11/2000 Ushijima et al. ..... 219/629

FOREIGN PATENT DOCUMENTS

JP 52-62745 * 5/1977 ..... 219/631
JP 6-123486 * 4/1994 ..... 219/630

* cited by examiner

*Primary Examiner*—Philip H. Leung
(74) *Attorney, Agent, or Firm*—Edwin D. Schindler

(57) ABSTRACT

An apparatus for heating liquids, such as cooking fat, includes a vessel for the liquid to be heated, an electrically inductive impeller disposed in the vessel, a motor for rotating the impeller, to cause the liquid to circulate around the vessel, and a electrical coil on the opposite side of a wall of the vessel to the impeller. A high frequency signal is applied to the coil, which generates a magnetic field that induces eddy currents in impeller. The impeller is not an ideal conductor and, therefore, the electrical energy is dissipated as heat, as current, flows through the impeller. The heat generated in the impeller is transferred to the liquid as it circulated around the vessel by the impeller.

10 Claims, 4 Drawing Sheets

LIQUID HEATING APPARATUS WITH AN INDUCTIVELY HEATED IMPELLER

This application is a continuation-in-part of application Ser. No. 09/784,513 filed Feb. 15, 2001 now abandoned.

BACKGROUND OF THE INVENTION

1. Field of the Invention

This invention relates to an apparatus for deep frying food products.

2. Related Background Art

Liquid heating apparatus generally rely on either an electric element disposed in the liquid to be heated or a low efficiency heat exchanger which indirectly heats the liquid by means of gas or electricity.

Such known apparatus are not energy efficient due to the many thermal interfaces involved in the process, they are expensive to run and in general occupy a relatively large amount of space.

It is therefore an object of the present invention to provide a liquid heating apparatus which is inexpensive to run and which does not occupy a large amount of space.

Another disadvantage of known liquid heating apparatus is that there is often an uneven temperature distribution throughout the heated liquid and this problem is particularly apparent in large heating vessels. Pumps are known which can be used to pump the heated liquid to evenly distribute the temperature. Another advantage of providing a pump is that the heated liquid can be distributed or passed though a treatment element such as a filter. However, the inclusion of a pump in the apparatus adds to the cost and physical size of the apparatus.

Many liquids such as wax and cooking fat solidify or become extremely viscous when cool and a problem with this is that the rotation of the impeller of any pump in the liquid will be inhibited when the liquid is cold. This can damage the motor which drives the impeller.

It is therefore an object of the present invention to provide a liquid heating apparatus which is able to provide an even temperature distribution throughout the liquid and which avoids the above problems associated with conventional circulation pumps.

SUMMARY OF THE INVENTION

In accordance with this invention, there is provided a liquid heating apparatus comprising an electrically inductive impeller disposed in a chamber arranged to contain the liquid to be heated, drive means arranged to rotate the impeller to induce a flow in the liquid in the chamber, and an electrical coil disposed adjacent the impeller and arranged to induce eddy currents therein.

In use, a high frequency signal (in excess of 20 kHz) is applied to the coil, which generates a magnetic field that induces eddy currents in impeller. The impeller is not an ideal conductor, and thus the electrical energy is dissipated as heat as current flows through the impeller. Thus, the heating effect is proportional to $I^2R$, where I is the current in the impeller and R is the electrical resistance of the impeller.

The resistivity of the impeller depends on the material that it is made from. Thus, it will be appreciated that the temperature which the impeller reaches will be dependent on the material of the impeller. The impeller directly heats the liquid and thus the apparatus is efficient. The impeller also acts to circulate the liquid and thus an even temperature distribution can be achieved without the requirement for a pump and separate heating element. The impeller can also be used to distribute the heated liquid or to pass it through a treatment element such as a filter. The apparatus will not be damaged if the material to be heated is of the kind whose viscosity is inversely proportional to temperature by virtue of the fact that the impeller rapidly heats up, thereby quickly heating the surrounding liquid and allowing the impeller to rotate normally. The impeller helps to distribute the locally heated liquid around the apparatus so that all of the material soon becomes fully flowable.

In a preferred embodiment, means may be provided for energizing the coil prior to rotation of the impeller, so as to reduce any risk of damage to the drive means before the surrounding material becomes fully flowable.

Many liquids expand as they change in temperature and it will be appreciated that this can damage the apparatus. Accordingly, preferably a wall of the chamber is resiliently deformable in order to allow expansion of the liquid as it changes in temperature.

Preferably the coil is disposed outside the chamber on an opposite side wall thereof to the impeller.

Preferably the wall is formed of a magnetically permeable material such as plastics or glass.

The amount of power required to heat a liquid is much greater than that for a gas and thus a large current has to be applied to the coil in order to quickly heat the liquid. furthermore, the temperature to which the liquid is to be heated is often high and this again necessitates a large coil current.

A disadvantage of large coil currents is that the coil itself can become very hot and potentially damaged due to $I^2R$ losses. This problem is exacerbated by the heat radiating from the heated liquid within the chamber. In order to overcome this problem, the coil is preferably separated from the wall of the chamber by an insulating layer of magnetically permeable material.

Preferably the layer of magnetically permeable material comprises air. Preferably a fan is provided for causing flow of the air in said layer.

Preferably the windings of the coil are open. Preferably the fan causes a flow of air through the coil windings.

Preferably the impeller is driven by a shaft, the fan being mounted on said shaft.

At high frequencies in the order of those used in the present invention, the current is confined to the skin of the coil winding owing to the so-called skin effect. This has the result of reducing the effective cross-sectional area of the winding carrying the current. Hence, the heating of the coil is further increased due to the corresponding increase in resistance of the coil. In order to overcome this problem, the coil preferably comprises windings which each comprise a plurality of electrically insulated conductors connected in parallel.

BRIEF DESCRIPTION OF THE DRAWINGS

Embodiments of this invention will now be described by way of examples only and with reference to the accompanying drawings, in which.

DETAILED DESCRIPTION OF THE PREFERRED EMBODIMENTS

Figure 1:
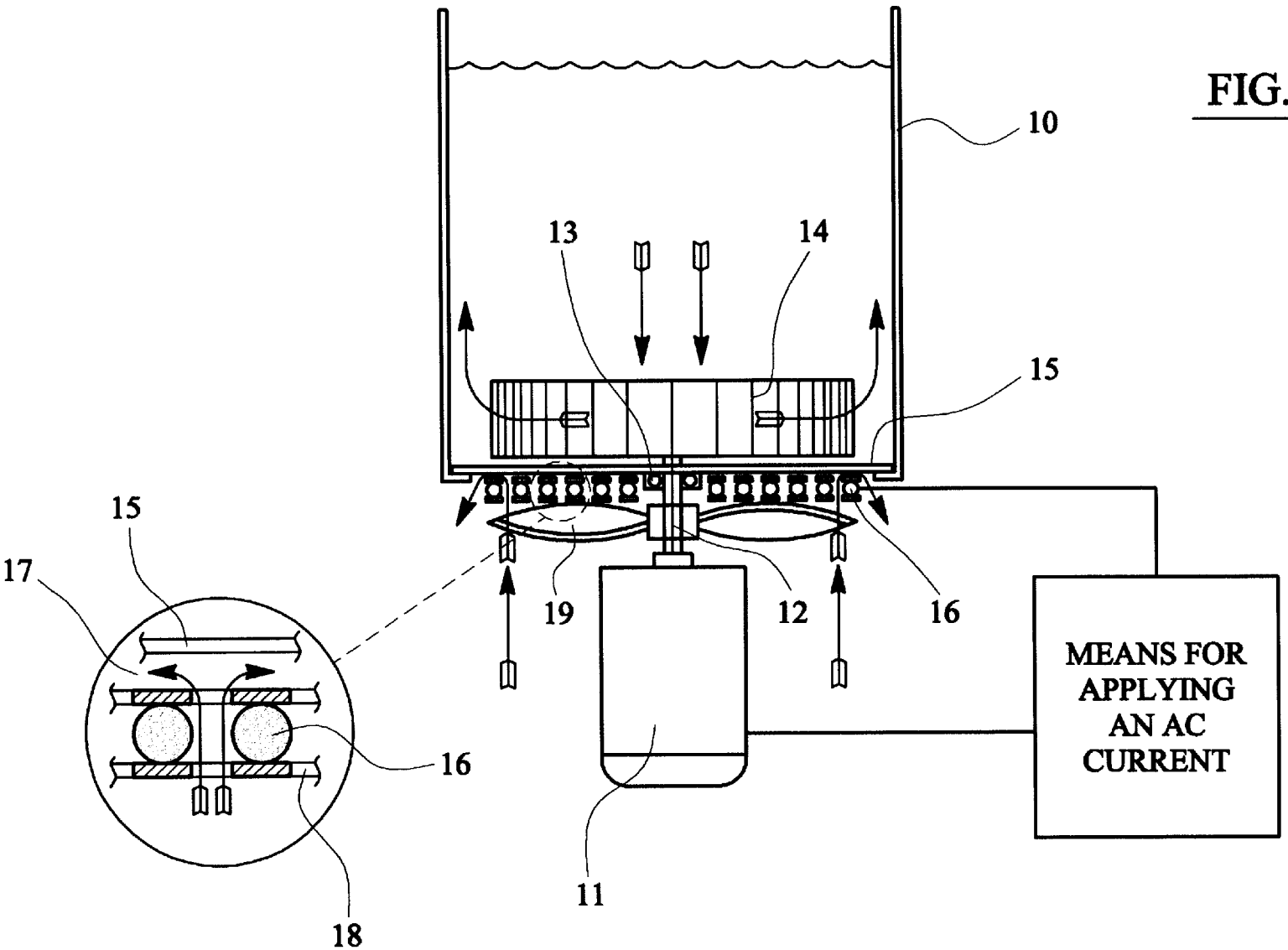
FIG. 1 is a sectional view through an embodiment of deep fat frier in accordance with this invention.

Referring to FIG. 1 of the drawings, there is shown a deep fat fryer comprising a flying vessel 10 for containing cooking fat. An electric motor 11 having a vertically extending rotary output shaft 12 is mounted to the underside of the bottom wall 15 of the vessel 10. The shaft 12 extends into the vessel 10 through a bearing and seal 13. Preferably the shaft 12 is a poor thermal conductor so that heat does not substantially conduct into the motor 11.

An impeller 14 mounted to the upper end of the shaft 12 inside the vessel for rotation about a vertical axis. The impeller 14 is a one piece formation of metal comprising a circular base lying normal to the axis of the shaft 12 and a plurality of axially extending vanes each lying in plane which extends substantially radially of the impeller. In use, as the impeller 14 is rotated, fat is drawn axially downwardly towards its center and is then expelled radially outwardly through its vanes.

The bottom wall 15 of the vessel 10 lies parallel to the base of the impeller 14. A substantially flat coil 16 is mounted adjacent the bottom wall 15, on the opposite side thereof to the impeller 14. The flat coil 16 lies normal to the axis of the shaft 12. The wall 15 is made of a material which allows electromagnetic waves to pass through it, such as plastic or glass.

Preferably the coil 16 is made from copper rope or braid, such as Litz wire, whereby the coil 16 is multi-stranded with each strand electrically insulated from each other.

The coil 16 is positioned adjacent to the impeller 14 and forms part of the resonant tank circuit of a high frequency power generator (not shown), which could be of the series resonant inverter type. When the coil 16 is powered with high frequency current a high frequency magnetic field is produced. The magnetic lines of force in the magnetic field produce eddy currents in the base of the impeller 14. These eddy currents flow in a circular path around each line of force in the metal and create heat in the metal due to its electrical resistance; hence the whole impeller 14 heats up.

The fat is circulated with high turbulence, which is important to achieve high heat transfer efficiency. This, in conjunction with the heat generated in the impeller 14 by the coil 16 provides a very efficient apparatus for heating the fat in the vessel 10.

A small gap 17 extends between the coil 16 and bottom wall 15 of the vessel in order to provide thermal isolation between the coil 16 and the vessel 10 of hot fat. The coil is supported by a former 18 which keeps adjacent turns of the coil windings apart. A fan 19 is mounted on the shaft 12 below the coil 16 and in use is arranged to direct a flow of air onto the coil 16 as the shaft 12 rotates. The flow of air flows through the open coil windings and thereby keeps the coil 16 cool.

A temperature sensor (not shown) may be used to control the fat temperature by regulating the motor speed and/or the power supplied to the induction coil 16. When the fat in the vessel 10 is cold it may solidify or become extremely viscous and it will be appreciated that this will inhibit rotation of the impeller 14 with the result that the motor 11 could be damaged. In order to overcome this problem, the coil 16 may be energised for a short period prior to energization of the motor, in order heat the fat surrounding the impeller 14 sufficiently for the impeller to turn relatively freely. Following energization of the motor 11, the heated fat soon heats the surrounding fat and the apparatus functions normally.

Figure 2:
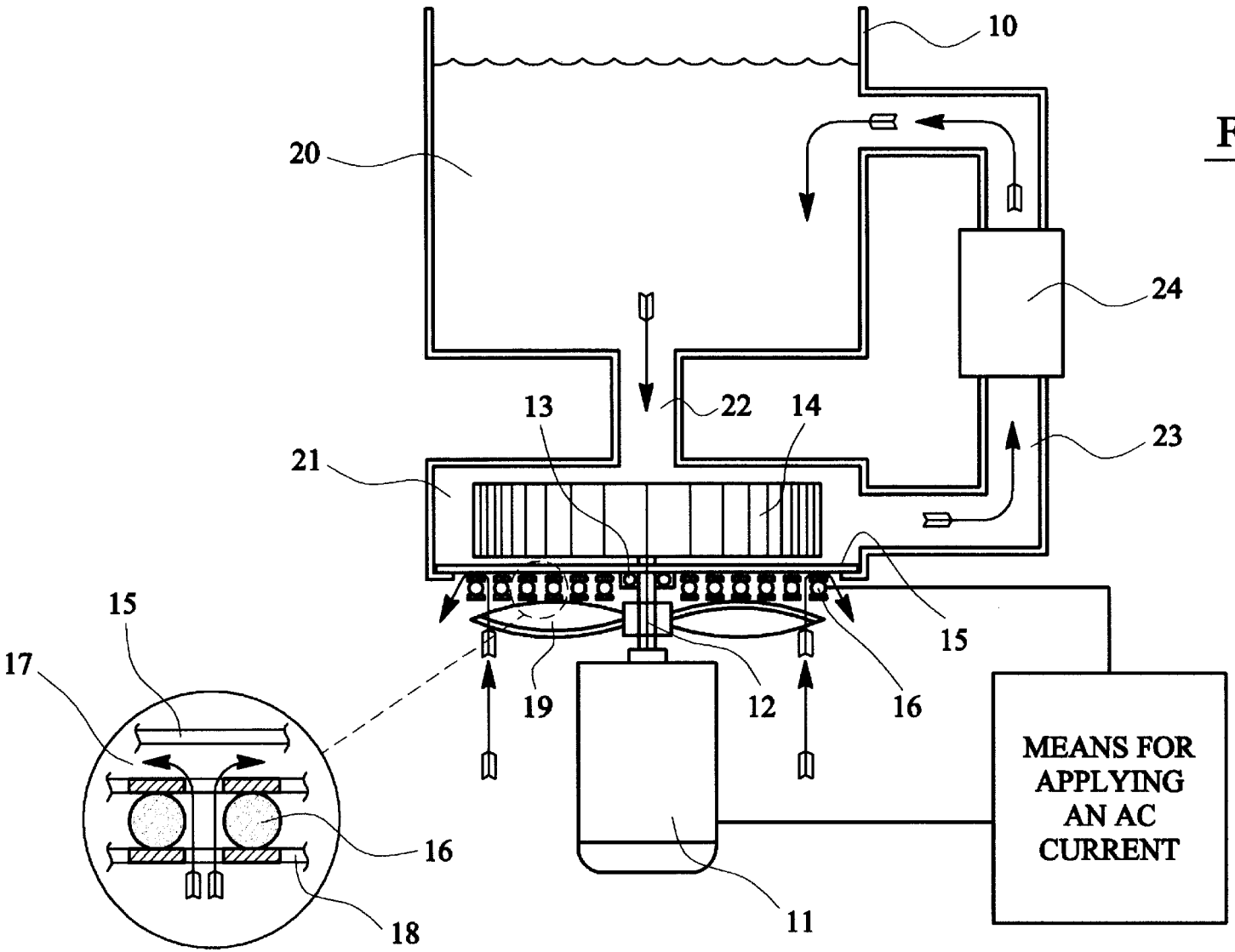
FIG. 2 is a sectional view through an alternative embodiment of deep fat frier in accordance with this invention.

Referring to FIG. 2 of the drawings, there is shown an alternative embodiment of deep fat frier and like parts are given like reference numerals. In this embodiment, the vessel 10 comprises a main chamber 20 and a sub-chamber 21 connected thereto by an inlet duct 22. The impeller 14 is mounted in the subchamber 21 with the center thereof in registration with the inlet duct 22. An outlet duct 23 extends from a side wall of the sub-chamber 21, radially of the impeller 14. The outlet duct is connected via a filter 24 to the main chamber 20.

In use, the apparatus functions exactly as before, except the fat is circulated through the filter 23 by the impeller 14.

Figure 3:
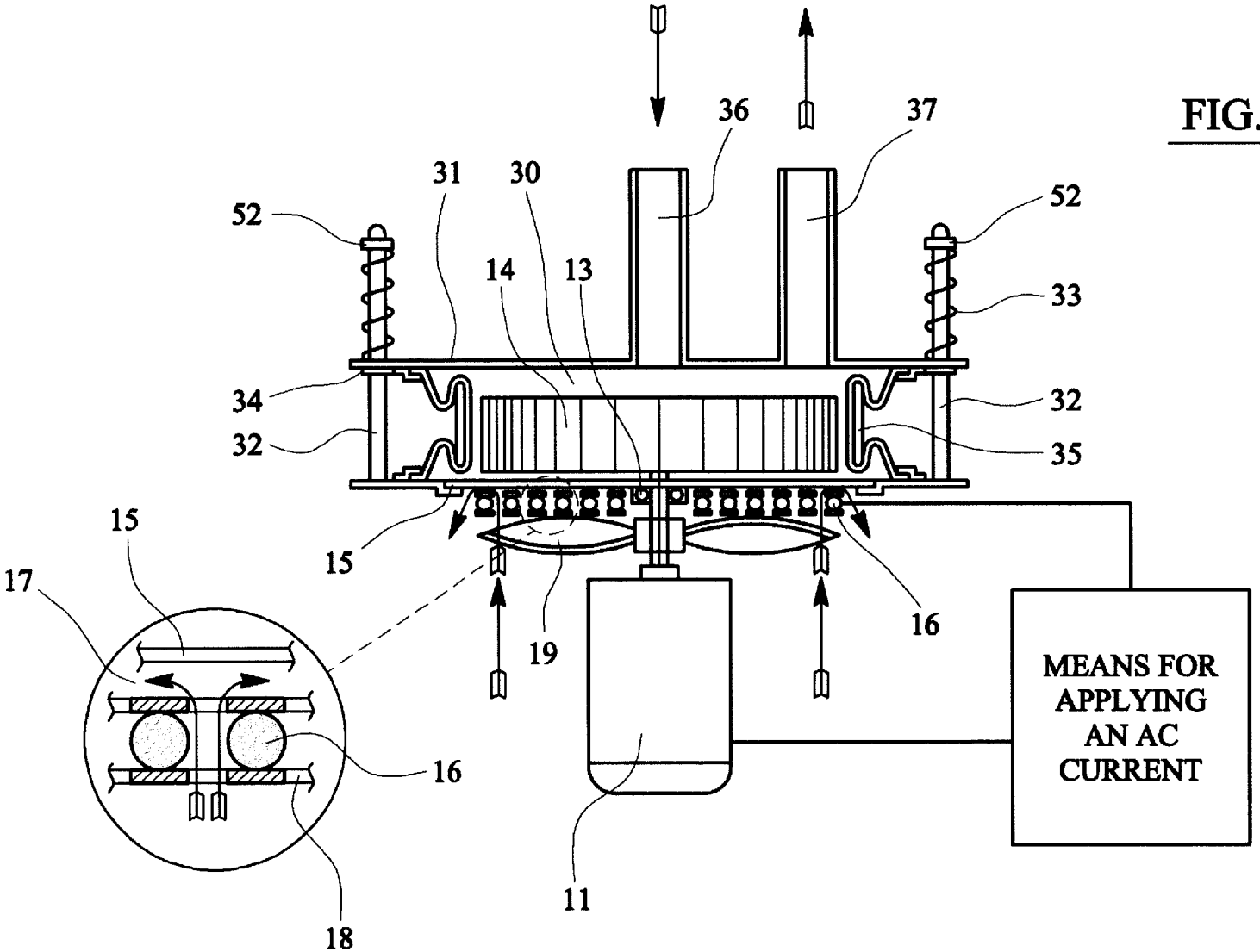
FIG. 3 is a sectional view through an embodiment of apparatus in accordance with this invention for heating chemicals.

Referring to FIG. 3 of the drawings, there is shown an apparatus for heating chemicals which is similar in principle to the apparatus of FIGS. 1 and 2 and like parts are given like reference numerals. The impeller 14 is mounted in a chamber 30, the bottom wall 15 of which is made of a material which allows electromagnetic waves to pass through it, such as plastic or glass. The upper wall 31 of the chamber 30 extends parallel to the lower wall 15 and is slidably mounted for movement perpendicular to its plane on a plurality of posts 32 extending perpendicularly from the bottom wall 15. The slidable upper wall 31 is biased towards the impeller 14 by helical coil springs 33 mounted on the posts 32. Helical coil springs 33 are fixed adjacent the top end of each post 32 by element 52. End stops 34 are provided on the posts 32 for limiting the travel of the slidable upper wall 31 towards the impeller 14.

An annular flexible diaphragm 35 extends around the impeller 14 between the upper and lower side walls 31,15 to form the side wall of the chamber. The impeller 14 is mounted in the chamber 30 with the center thereof in registration with an inlet duct 36 extending from the slidable upper wall 31. An outlet duct 37 extends from the slidable upper wall 31 adjacent the radially outermost portion of the impeller 14.

In use, the apparatus functions exactly as before, except the upper wall 31 of the chamber 30 moves away from the lower wall 15 to increase the volume of the chamber 30 as the chemical expands with change in temperature, thereby alleviating the risk of damage to the casing cased by the expansion.

Referring to FIG. 3 of the drawings, there is shown an apparatus for heating chemicals which is similar in principle to the apparatus of FIGS. 1, 2 and 3 and like parts are given like reference numerals. In this embodiment, two impellers 14 are mounted back-to-back on a hollow shaft 40 which extends through a pump chamber 41. The coil 16 is sealingly mounted between the two impellers 14 in an inner chamber 42. A cooling fan 43 is also mounted in the inner chamber 42 and comprises a flat disc mounted to the shaft and extending normal to the axis thereof A plurality of blades 44 are disposed circumferentially of the disc at its radially outermost point. A plurality of apertures 45 are formed in the hollow shaft 40 to communicate between the inner chamber 42 an the interior of the hollow shaft 40.

The inner chamber 42 comprises opposite side walls 50 which are made of a material which allows electromagnetic waves to pass through them, such as plastic or glass. The disc of the fan 43 is made of a similar material.

The impellers 14 are mounted in the pump chamber 41 with the centers thereof in registration with respective inlet ducts 46 extending from a main inlet duct 47. An outlet duct 47 extends radially outwards of the impellers 14 from the pump chamber 41.

In use, when the shaft 40 is rotated, the liquid to be heated is drawn from the main duct 44 into the inlet ducts 46, whereupon it is forced radially outwards through the blades of the impellers into the outlet duct 47 via the periphery of the pump chamber 41.

The coil 16 inductively heats the impellers 14 and this heat is transferred to the liquid. In order to cool the coil 16, the rotating fan 43 draws air axially along the hollow shaft 40 into the inner chamber 42 through the apertures 45. The air then flows radially over the coil 16 to the periphery of the inner chamber 42, whereupon the air is exhausted through an outlet duct (not shown).

Figure 4:
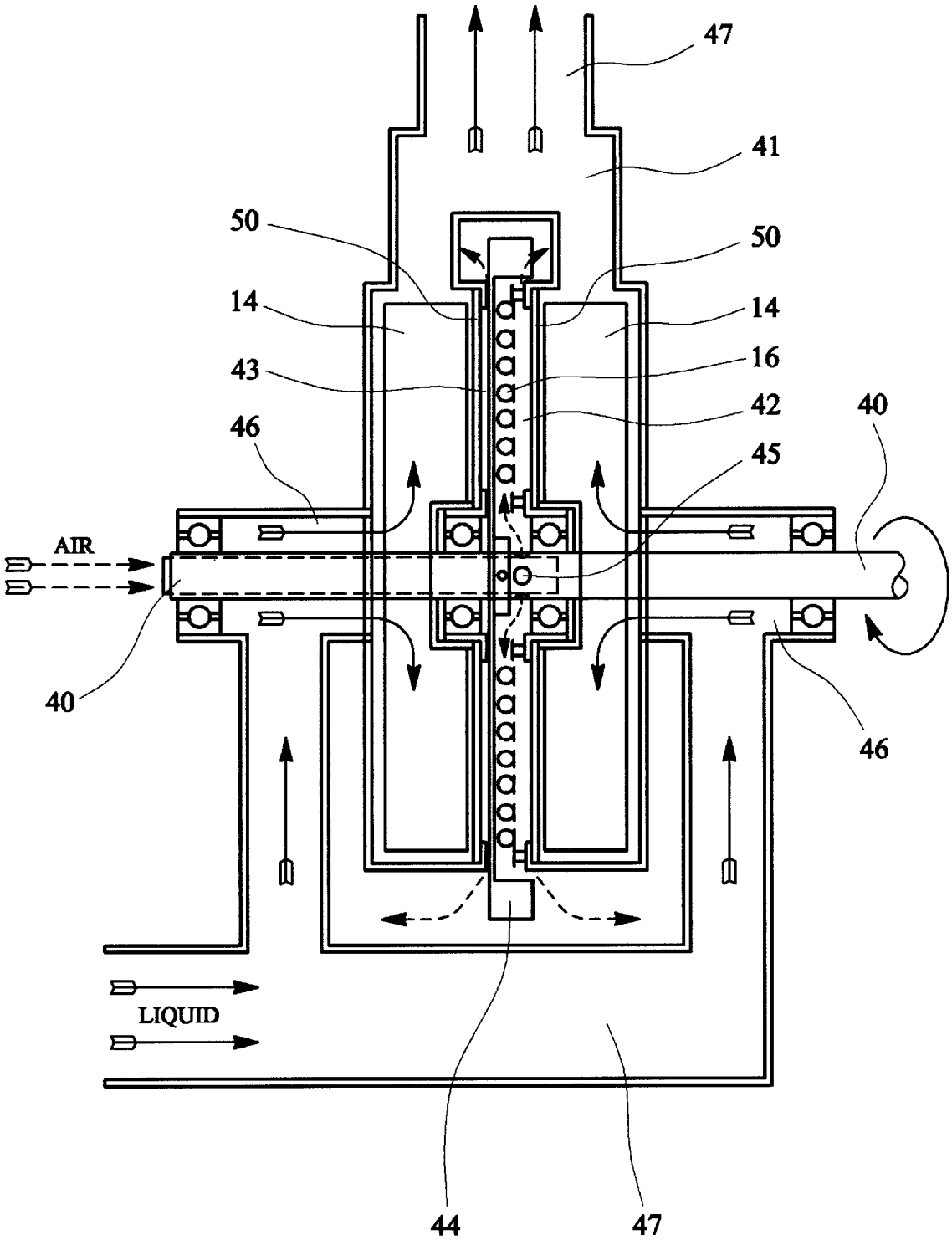
FIG. 4 is a sectional view through an alternative embodiment of apparatus in accordance with this invention for heating chemicals.

The apparatus of FIG. 4 is capable of heating liquids rapidly to high temperatures owing to the use of two impellers 14 on respective opposite sides of the coil 16.

Although the present invention has been described with reference to preferred embodiments, persons skilled in the art will recognize that changes may be made in form and detail without departing from the spirit and scope of the invention.

What is claimed is:

1. A liquid heating apparatus, comprising:

a chamber having a magnetically permeable wall for containing a liquid to be heated;

an electrically inductive impeller mounted inside said chamber adjacent said magnetically permeable wall;

drive means for rotating said electrically inductive impeller for inducing a flow of the liquid in said chamber;

an electrical coil adjacent said electrically inductive impeller on an opposite side of said magnetically permeable wall for inductively heating said electrically inductive impeller by directly inducing eddy currents therein; and, means for applying an alternating current to said electrical coil for inductively heating said electrically inductive impeller prior for energizing said drive means.

2. The liquid heating apparatus according to claim 1, wherein said electrical coil is outside said chamber on an opposite side wall thereof to said electrically inductive impeller, said electrical coil being separated from said magnetically permeable wall of said chamber by an insulating layer of magnetically permeable material.

3. The liquid heating apparatus according to claim 2, wherein said layer of magnetically permeable material includes air.

4. The liquid heating apparatus according to claim 3, further comprising a fan for causing flow of the air in said layer of magnetically permeable material.

5. The liquid heating apparatus according to claim 4, wherein windings of said electrical coil are open with said fan being arranged for causing a flow of air through said windings.

6. The liquid heating apparatus according to claim 4, further comprising a shaft for driving said electrically inductive impeller, said fan being mounted on said shaft.

7. The liquid heating apparatus according to claim 3, wherein windings of said electrical coil each comprise a plurality of electrically insulated conductors connected in parallel.

8. The liquid heating apparatus according to claim 1, comprising a pair of electrically inductive impellers on opposite sides of said electrical coil.

9. The liquid heating apparatus according to claim 1, wherein windings of said electrical coil are open.

10. The liquid heating apparatus according to claim 1, wherein windings of said electrical coil each comprise a plurality of electrically insulated conductors connected in parallel.

* * * * *